US009279348B2

(12) United States Patent
Lauer et al.

(10) Patent No.: US 9,279,348 B2
(45) Date of Patent: Mar. 8, 2016

(54) MECHANICALLY CONTROLLABLE VALVE DRIVE FOR A RECIPROCATING PISTON ENGINE

(71) Applicant: KOLBENSCHMIDT PIERBURG INNOVATIONS GMBH, Neckarsulm (DE)

(72) Inventors: Frederic Lauer, Oberriexingen (DE); Daniel Hosse, Neunkirchen (DE); Rudolf Flierl, Hirschau (DE)

(73) Assignee: KOLBENSCHMIDT PIERBURG INNOVATIONS GMBH, Neckarsulm (DE)

( * ) Notice: Subject to any disclaimer, the term of this patent is extended or adjusted under 35 U.S.C. 154(b) by 11 days.

(21) Appl. No.: 14/047,022

(22) Filed: Oct. 7, 2013

(65) Prior Publication Data

US 2014/0096730 A1 Apr. 10, 2014

(30) Foreign Application Priority Data

Oct. 8, 2012 (DE) ..... 10 2012 109 538

(51) Int. Cl.
*F01L 1/34* (2006.01)
*F01L 1/04* (2006.01)
(Continued)

(52) U.S. Cl.
CPC ... *F01L 1/04* (2013.01); *F01L 1/08* (2013.01); *F01L 9/04* (2013.01); *F01L 13/0063* (2013.01); *F01L 2013/0068* (2013.01)

(58) Field of Classification Search
CPC ..... F01L 2013/0073; F01L 2013/0068; F01L 13/0063
USPC ..... 123/90.15, 90.16
See application file for complete search history.

(56) References Cited

U.S. PATENT DOCUMENTS 4,424,790 A 1/1984 Curtil
5,546,914 A 8/1996 Scheinert
(Continued)

FOREIGN PATENT DOCUMENTS

DE 44 24 802 C1 7/1995
DE 196 29 349 A1 1/1998
(Continued)

OTHER PUBLICATIONS

V. Küntscher: "Kraftfahrzeugmotoren—Auslegung und Konstruktion", VEB Verlag Technik Berlin, English Translation, pp. 416-417 (1987).

*Primary Examiner* — Thomas Denion
*Assistant Examiner* — Daniel Bernstein
(74) *Attorney, Agent, or Firm* — Norman B. Thot

(57) ABSTRACT

A mechanically controllable valve drive for a reciprocating piston engine configured to adjust a gas exchange valve includes the gas exchange valve, a cam assembly comprising a camshaft and at least one cam for the gas exchange valve, a valve, a valve lift adjustment assembly, a drag lift assembly, and a device. The valve lift adjustment assembly comprises a valve lift adjustment device, and an intermediate lever assembly comprising at least one intermediate lever comprising a working curve comprising curve portions. The valve lift adjustment assembly is configured to shift the valve between a zero lift and a maximum lift. The drag lever assembly is operatively connected to the working curve. The device is configured to provide a valve-lift standstill range so that, in a maximum lift position, the valve is opened for a turning angle ω of the camshaft with a flattened valve lift height.

11 Claims, 3 Drawing Sheets

(51) Int. Cl.

| | |
|---|---|
| ***F01L 1/08*** | (2006.01) |
| ***F01L 9/04*** | (2006.01) |
| ***F01L 13/00*** | (2006.01) |

(56) References Cited

U.S. PATENT DOCUMENTS

| | | | | |
|---|---|---|---|---|
| 5,588,411 | A * | 12/1996 | Kreuter et al. | 123/339.14 |
| 6,405,693 | B2 * | 6/2002 | Yoeda et al. | 123/90.15 |
| 7,475,659 | B2 * | 1/2009 | Arnell | 123/90.16 |
| 7,856,952 | B2 | 12/2010 | Armer | |
| 2004/0144347 | A1 * | 7/2004 | Schleusener et al. | 123/90.16 |
| 2004/0231639 | A1 * | 11/2004 | Israel et al. | 123/321 |
| 2007/0012269 | A1 | 1/2007 | Schleusener et al. | |
| 2007/0028876 | A1 | 2/2007 | Fujita | |
| 2007/0144474 | A1 * | 6/2007 | Kitagawa et al. | 123/90.16 |
| 2007/0266971 | A1 | 11/2007 | Bosl-Flierl et al. | |
| 2008/0017146 | A1 * | 1/2008 | Meyer et al. | 123/90.16 |
| 2008/0078345 | A1 * | 4/2008 | Knauf et al. | 123/90.17 |
| 2008/0127922 | A1 * | 6/2008 | Siepmann et al. | 123/90.16 |
| 2008/0168958 | A1 * | 7/2008 | Conti | 123/90.15 |
| 2009/0050085 | A1 | 2/2009 | Lanteires et al. | |
| 2013/0104819 | A1 * | 5/2013 | Fernandez | 123/90.15 |
| 2013/0199472 | A1 | 8/2013 | Flierl | |
| 2013/0220251 | A1 * | 8/2013 | Flierl | 123/90.16 |

FOREIGN PATENT DOCUMENTS

| | | | |
|---|---|---|---|
| DE | 100 66 054 | R4 | 6/2002 |
| DE | 101 40 635 | A1 | 4/2003 |
| DE | 103 12 962 | A1 | 10/2004 |
| DE | 10 2004 001 343 | A1 | 9/2005 |
| DE | 10 2004 008 389 | A1 | 9/2005 |
| DE | 10 2010 048 709 | A1 | 4/2012 |
| EP | 1 618 293 | B1 | 1/2006 |

* cited by examiner

MECHANICALLY CONTROLLABLE VALVE DRIVE FOR A RECIPROCATING PISTON ENGINE

CROSS REFERENCE TO PRIOR APPLICATIONS

Priority is claimed to German Patent Application No. DE 10 2012 109 538.8, filed Oct. 8, 2012. The entire disclosure of said application is incorporated by reference herein.

FIELD

The present invention relates to a mechanically controllable valve drive for a reciprocating piston engine, for example, for an internal combustion engine of an automobile, provided for adjustment of gas exchange valves. The mechanically controllable valve drive comprises a cam assembly including a camshaft and at least one cam for each gas exchange valve. The valve drive further comprises a valve lift adjustment assembly which is operative for shifting the valve between a zero lift and a maximum lift and which substantially comprises a valve lift adjustment means including at least one intermediate lever having a working curve, said working curve including various curve portions. The mechanically controllable valve drive further comprises a drag lever assembly to which the working curve is operatively connected.

BACKGROUND

Mechanically controllable valve drives of the above type are well known from the state of the art in the field of internal combustion engines. They have in particular the purpose, by use of the valve lift height and the duration of the opened state of the valve, and thus by use of the filling degree of the cylinders in the internal combustion engine, to adapt the combustion process to the respective load requirements and, correspondingly, to achieve a maximally efficient and thus also a low-pollutant combustion. Apart from this, it is known that in certain load ranges, especially in the part-load range, a certain number of cylinders can be completely switched off, for example, in a four-cylinder engine, in order to run the engine merely with two cylinders. For this purpose, the gas exchange valve is operated in the zero-lift range, which at the same time means that the valve acceleration in this range is zero. This zero-lift range is followed by an adjustment range which at a certain turning angle point will effect a maximum lift of the gas exchange valve. The integral under the whole valve-lift curve will thus determine the filling volume in a gas-exchange inlet valve and, respectively, the exhaust-gas discharge volume in a gas-exchange outlet valve.

With respect to the filling volume, a valve drive of the above design is thus dependent on the maximum obtainable valve lift. In this regard, particularly large valve lifts have the disadvantage that they require a large constructional space to allow for adjustability, that they entail a danger of piston collision and, respectively, that there will be generated higher frictional forces during an opening process against the return spring of the gas exchange valve.

SUMMARY

An aspect of the present invention is to provide a mechanically controllable, fully variable valve drive for a reciprocating piston engine which avoids the above-described disadvantages.

In an embodiment, the present invention provides a mechanically controllable valve drive for a reciprocating piston engine configured to adjust a gas exchange valve which includes the gas exchange valve, a cam assembly comprising a camshaft and at least one cam for the gas exchange valve, a valve, a valve lift adjustment assembly, a drag lift assembly, and a device. The valve lift adjustment assembly comprises a valve lift adjustment device, and an intermediate lever assembly comprising at least one intermediate lever comprising a working curve comprising curve portions. The valve lift adjustment assembly is configured to shift the valve between a zero lift and a maximum lift. The drag lever assembly is operatively connected to the working curve. The device is configured to provide a valve-lift standstill range so that, in a maximum lift position, the valve is opened for a turning angle ω of the camshaft with a flattened valve lift height.

BRIEF DESCRIPTION OF THE DRAWINGS

The present invention is described in greater detail below on the basis of embodiments and of the drawings in which.

DETAILED DESCRIPTION

Figure 1:
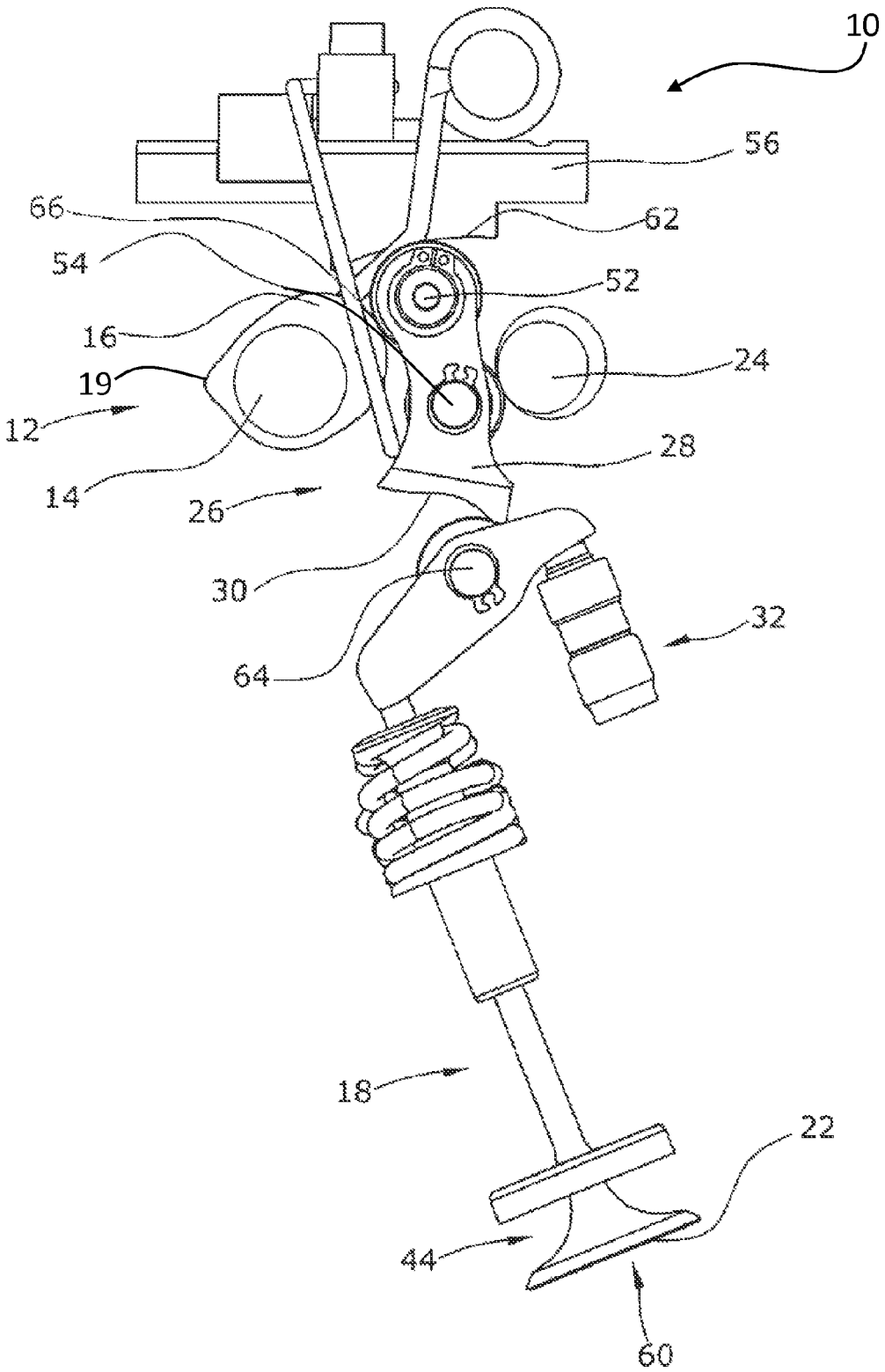
FIG. 1 shows a view of an embodiment of the device according to the present invention for a gas exchange valve at maximum lift.

In an embodiment of the present invention, means are provided which render available a valve-lift standstill portion in such a manner that, in the maximum lift position, the valve is opened for a cam turning angle ω with a flattened, for example, a constant valve lift height. This makes it possible, in a simple fashion, to carry out particularly fast valve lifts while merely requiring a small constructional space and achieving a high filling degree. Such a valve-lift standstill portion is distinguished in that the rise and thus the acceleration will tend toward zero or will be zero in said range.

In an embodiment of the present invention, said means comprise a working curve having a valve-lift standstill portion, said working curve, when viewed in the opening direction of the gas exchange valve, including a zero lift portion, an adjustment portion and the valve-lift standstill portion. This arrangement makes it possible to adapt the valves individually and variably and, subsequently, within a defined, longer cam turning angle ω, to maintain the achieved valve position in a largely constant manner. By the special design of the valve-lift standstill portion, the valve in the maximum lift position of the mechanically controllable valve drive is opened for a cam turning angle ω with a flattened, for example, a constant valve lift height. The camshaft could alternatively be configured to achieve a valve-lift standstill portion.

In an embodiment of the present invention, the intermediate lever can, for example, comprise, on its first arm, i.e., on the side opposite to the working contour, a first roll which by the cam of the camshaft is directly or indirectly moved on a sliding path. The intermediate lever further comprises, in its pivot center, a second roll rolling on a contour of the valve lift adjustment means. The valve lift adjustment means defines the maximal valve lift height, the opening period etc. By adjusting the intermediate lever, i.e., the change of the position of the pivot center of the intermediate lever in relation to the valve lift adjustment means, the valve lift height and, respectively, the opening period will be adjusted.

In an embodiment of the present invention, the intermediate lever is obtained in that, on its second arm, i.e., on the side opposite to the sliding block, the intermediate lever comprises said working curve cooperating with a third roll of the drag lever assembly. The drag lever assembly is in turn operatively connected to a gas exchange valve.

The arrangement described herein is distinguished by a compact design while the adjusting of the valves is simple.

Both the zero lift portion and the valve-lift standstill portion can, for example, describe a part of a curved path about the pivot point of the axis of the first roll, the radius $r_1$ of the valve-lift standstill portion being larger than the radius $r_2$ of the zero lift portion.

The drag lever assembly is no longer located in the zero-lift position since, in the region of the valve-lift standstill portion, the center of the sliding block is, as a result, only approximately located in the axial center of the third roll of the drag lever assembly. The geometric relationships are thereby slightly changed so that the range of the working curve that is provided for limiting the valve lift still describes a circle around the axial center of the third roll of the drag lever assembly in only an approximate manner.

In an embodiment of the present invention, the turning angle ω of the camshaft in the range of the valve-lift standstill can, for example, have a value of between 30° and 150°. The development of the acceleration in the range of the valve-lift standstill for a camshaft turning angle range between 30° and 150° can further, for example, present an acceleration of 0 $mm/rad^2$.

The gas exchange valve actuating device further comprises at least one hydraulic actuator.

The gas exchange valve can be formed both as an inlet valve and an outlet valve. Thus, particularly in the Otto engine, such valve drive arrangements allow for an internal recirculation of exhaust gas since the constriction on the suction side provides for a high pressure difference, with a driving effect, between the exhaust gas side and the cylinder suction side.

In an embodiment of the present invention, it is provided that, in the area of the gas exchange valve actuating device, at least one gas exchange valve can, for example, be designed as an outlet valve.

In an embodiment of the present invention, at least one gas inlet valve can, for example, be controlled by a variable valve drive.

In an embodiment of the present invention, the intermediate lever can, for example, be supported by a circular contour on the valve lift adjustment means, wherein the contour can also be supported on roll held by a sliding or rolling bearing.

Friction losses and component wear are considerably reduced as a result of the overall arrangement, and the operating life of the variable-lift valve drive is distinctly extended. On the whole, the variable-lift valve drive has a higher mechanical stability, which is to say, inter alia, that the drive is less vulnerable under the aspect of vibration technology and is subjected to fewer acceleration and oscillation forces. This makes it possible, on the one hand, due to the reduction of the vibration-induced problems, to increase the rotational speed of the internal combustion engine without problems and, further, to design the spring element with smaller dimensions, thus allowing the attainment of distinctly higher rotational speeds also in connection with the reduced acceleration forces of the intermediate lever. A higher efficiency of the engine can be assumed as a further favorable effect of the reduction of the inner friction.

The present invention will be explained in greater detail hereunder with reference to the drawings.

The valve drive described hereunder is well-known under the name "Univalve". As to the design and the functionality of such a valve drive, reference is made to EP 1 618 293 B1.

An embodiment of a mechanically controllable valve drive 10 is shown in FIG. 1. The mechanically controllable valve drive 10 for a reciprocating piston engine substantially comprises an intermediate lever 28 which is slidably supported in a sliding path 62 of a sliding block 56 disposed in a stationary manner in a cylinder head, not shown. The shape of the sliding block 56 is defined by a circular arc extending around the axial center of the first roll 52. In the area of this first roll 52, a cam assembly 12 comprising a camshaft 14 is arranged which, together with a first cam 16, can be displaced directly or indirectly and thereby will drive the gas exchange valve 18. For rendering possible an internal exhaust gas recirculation in a simple and inexpensive manner, camshaft 14 further comprises a second cam 19 to allow for a secondary lift of the valve lift curve of the gas exchange valve 18. By means of camshaft 14, the gas exchange valve 18 will be cyclically opened and closed as far as an operative connection exists between the working curve 30 and a third roll 64 of a drag lever assembly 32. Of course, alternative embodiments of intermediate levers are also included under the scope of the present invention. Thus, for instance, two intermediate levers can be arranged on an axis comprising a roll, wherein, then, this roll is guided by a sliding block. In this regard, reference is made to DE 10 140 635 A1.

Coaxially to the first roll 52 and substantially in the middle between the sliding path 62 and the working curve 30, there is arranged a valve lift adjustment means 24 which acts on a second roll 54. By means of said valve lift adjustment means 24, the absolute lift of gas exchange valve 18 and the opening time of a valve 22 of a working cylinder 60 will be set.

On the opposite end relative to sliding path 62, the intermediate lever 28 comprises a working curve 30 having a zero lift portion 40, an adjustment lift portion 42 and said valve-lift standstill portion 34. The intermediate lever 28 comprises, on its first arm, i.e., on the side opposite to the working curve 30, a first roll 54 which by the cam of the camshaft 14 is directly or indirectly moved on a sliding path. The intermediate lever 28 further comprises, in its pivot center 66, the second roll 54 rolling on a contour of the valve lift adjustment means 28.

Further, the intermediate lever 28 is operatively connected to a drag lever assembly 32 via a third roll 64. Through this operative connection, various valve lift positions of the gas exchange valve 18 can be set. The drag lever assembly 32 is, on the one hand, supported on a play compensation element, for example, a hydraulic valve play compensation element, and is operative together with the gas exchange valve 18. The gas exchange valve 18 and said valve play compensation element are mounted in the cylinder head, not illustrated here.

When the line contact of the third roll 64 is located in the zero lift portion 40 of working curve 30, then the gas exchange valve lift 44 will be zero; when the line contact is shifted in the opening direction along the adjustment portion 42 of working curve 30 as far as to the valve-lift standstill portion 34, the lift of the gas exchange valve 18 is enlarged up to a maximum value. When the line contact then reaches the range of valve-lift standstill portion 34, the maximally reached value for a defined cam turning angle ω, here about 40°, will be kept nearly constant.

By use of the working curve 30, intermediate lever 28 will always be in motion, so that no static surface pressing will occur in the contact faces and a sufficient lubrication of the contact faces will be provided at all times. The inventive designs thus leads to less friction and decreased wear. Further, by the use of the valve lift adjustment means 24, the opening and closing movements of the intermediate lever are considerably reduced, thus allowing for markedly higher rotational speeds of the internal combustion engine. The possibility of a smaller dimensioning of the spring element is a further advantage. Resonance effects in the spring element are further avoided by the permanent motion of intermediate lever 28. By the optimization of the spring element, higher rotational speeds can in turn be reached, while friction and wear are minimized.

Figure 2:
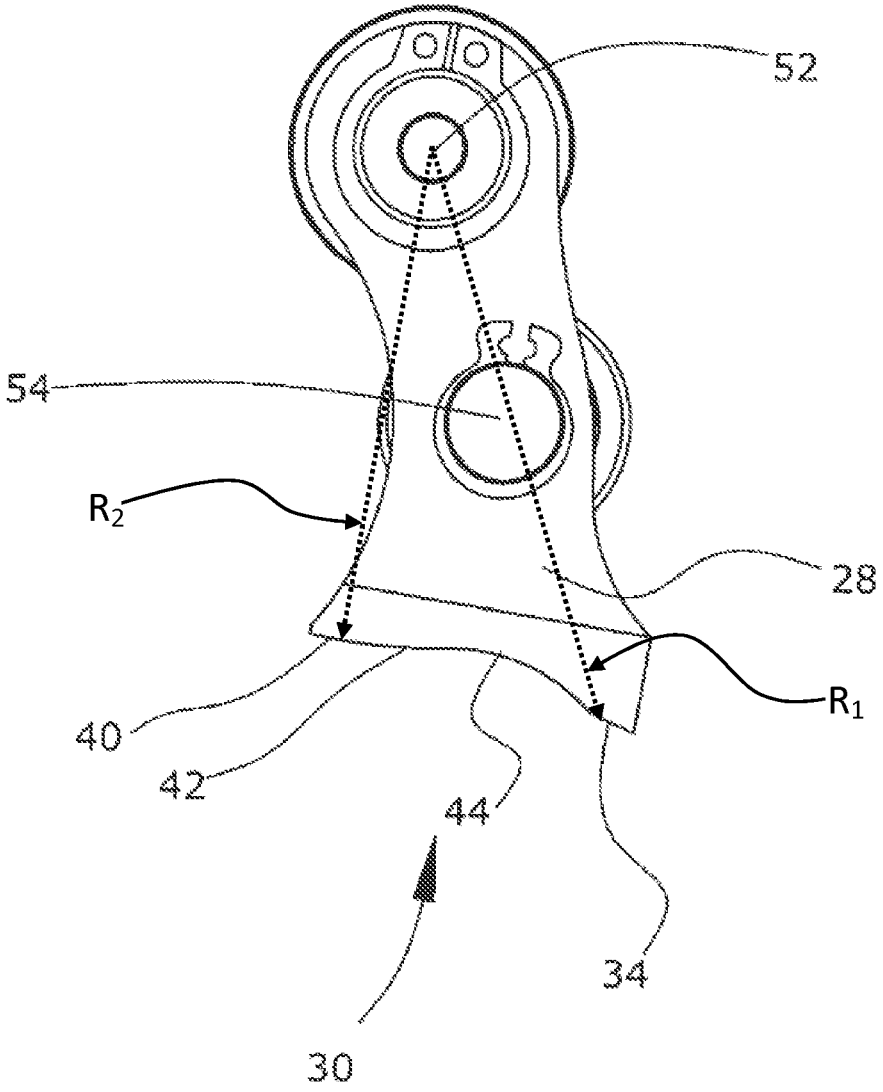
FIG. 2 shows a perspective view of an embodiment of the intermediate lever having the working curve according to the present invention.

FIG. 2 is a partial view of the mechanically controllable valve drive 10 which shows the intermediate lever 28 with the appertaining working curve 30. When viewed in the opening direction, the working curve 30 includes the zero lift portion 40, the adjustment portion 42 and the valve-lift standstill portion 34. By this sequence of the portions of the working curve 30, the opening characteristic of the gas exchange valve 18 is defined. The individual portions are connected to each other by transition radii and are connected to each other throughout the range of the working curve 30.

The various portions of the working curve 30 are operative to influence, apart from the lift height and the opening period of the valve 22, also the acceleration behavior of the valve 22 of the internal combustion engine. By the partly constant valve lift, also the acceleration toward defined camshaft turning angles w is defined to tend toward nearly zero.

Figure 3:
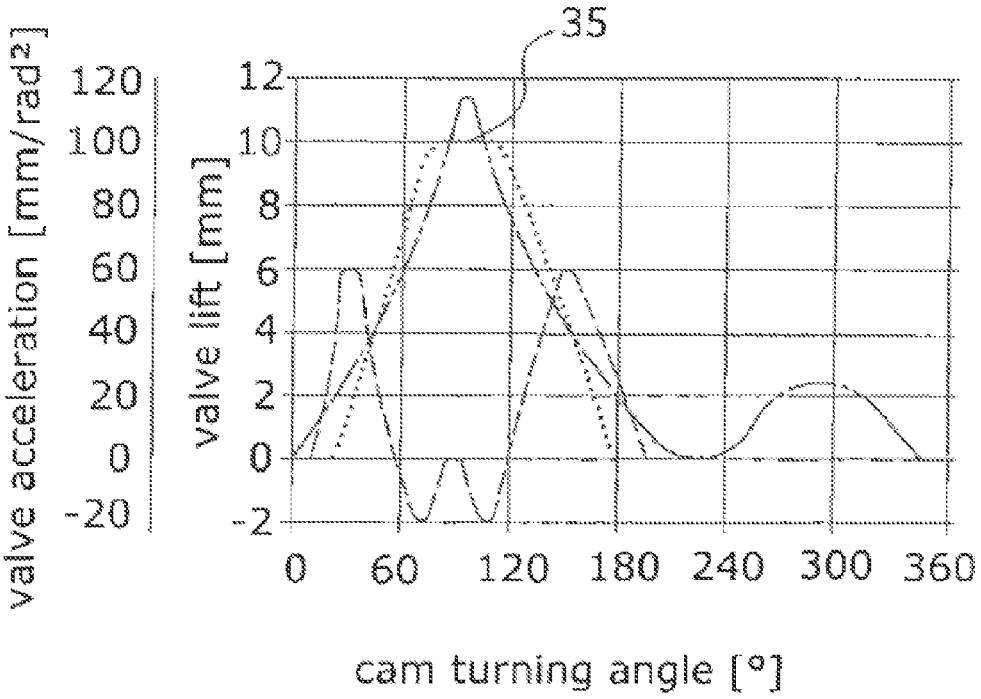
FIG. 3 shows a diagram wherein the valve lift [mm] and the valve acceleration [rad/mm$^2$] are respectively shown along the Y-axis, and the cam turning angle ω[°] is shown along the X-axis.

FIG. 3 shows a diagram wherein a valve lift and the valve acceleration of the gas exchange valve 18 of FIG. 2 are plotted in relation to a cam turning angle ω of an internal combustion engine. The dotted line indicates the development of the lift path of valve 22, and the interrupted line indicates the development of the acceleration of valve 22. As compared to the conventional valve lift curve (see the chain-dotted line) of the gas exchange outlet valve 18, i.e., without valve-lift standstill portion, the modified valve-lift path curve comprises a substantially constant, unchanged lift portion, the valve-lift standstill range 35, over a cam turning angle range ω in a region between 70° and 110°. The valve acceleration curve of the acceleration development with the valve-lift standstill range 35 also shows a range of the acceleration of 0 mm/rad$^2$. It is thereby achieved that a large filling volume is provided with a smaller, conventional maximum lift. The valve-lift standstill range 35 is located in the range of the valve acceleration of zero and the constant valve lift path at a cam turning angle ω of about 100°. This flattened, particularly constant valve-lift standstill range 35 extends over a cam turning angle ω of about 40°, but can also extend over a larger range such as, for example, 150°. At this time, valve 22 will not be opened still farther. By the standstill, the mechanical expenditure and the friction generated by the spring force are reduced, and further constructional space is saved. This arrangement will reveal less indicators of wear in comparison to other, known arrangements. It should be evident that it is of course also possible to give the valve-lift standstill range 35 a very flattened shape, i.e., with small acceleration. For the present invention, it is important that the gradient in the range of the maximum stroke of the curve will tend to change toward zero.

Further, in FIG. 3, a second valve lift (second event) of the gas exchange valve 18 is shown. Exhaust gas existing in the exhaust gas discharge duct can thereby flow back through the opened gas exchange outlet valve 18 into the cylinder, and thus be again made available for the subsequent combustion process.

An increase of the maximum lift in the second event, set by the valve lift adjustment assembly, will also result in an increase of the maximum lift 44 in the primary lift, but this will not lead to such a distinct increase as in a conventional gas exchange valve 18.

The present invention is not limited to embodiments described herein; reference should be had to the appended claims.

What is claimed is:

1. A mechanically controllable valve drive for a reciprocating piston engine configured to adjust a gas exchange valve, the mechanically controllable valve drive comprising:

the gas exchange valve;

a cam assembly comprising a camshaft and at least one cam for the gas exchange valve;

a valve;

a valve lift adjustment assembly comprising:

a valve lift adjustment device, and an intermediate lever assembly comprising at least one intermediate lever comprising a working curve comprising curve portions, the valve lift adjustment assembly being configured to shift the valve between a zero lift and a maximum lift;

a drag lever assembly operatively connected to the working curve; and a device configured to provide a valve-lift standstill range so that, in a maximum lift position, the valve is opened for a turning angle ω of the camshaft with a flattened valve lift height, wherein, the device comprises the working curve which comprises a valve-lift standstill portion, the working curve, when viewed in succession, comprising a zero lift portion, an adjustment portion, and the valve-lift standstill portion, the valve-lift standstill portion being configured to flatten with respect to the adjustment portion, a valve-lift curve for the valve-lift standstill portion comprises a substantially constant, unchanged lift portion which defines a valve-lift standstill range, and the valve-lift standstill range exists over a turning angle ω of the camshaft in the valve-lift standstill portion of between 30° and 150°.

2. The mechanically controllable valve drive as recited in claim 1, further comprising:

a sliding block comprising a sliding path, wherein, the drag lever assembly further comprises a third roll, and the intermediate lever further comprises a first arm comprising a first roll, a pivot center, and a second roll arranged in the pivot center which is configured to roll on a contour of the valve lift adjustment device, the first roll being configured to move directly or indirectly via the cam of the camshaft on the sliding path of the sliding block, and a second arm comprising the working curve, the second arm being configured to cooperate with the third roll of the drag lever assembly.

3. The mechanically controllable valve drive as recited in claim 2, wherein the sliding path defines a curved path about a center of the third roll of the drag lever assembly.

4. The mechanically controllable valve drive as recited in claim 2, wherein the valve-lift standstill portion comprises a radius $r_1$ and the zero lift portion comprises a radius $r_2$, the zero lift portion and the valve-lift standstill portion both define a part of a curved path about a pivot point of a center of an axis of the first roll, the radius $r_t$ of the valve-lift standstill portion being larger than the radius $r_2$ of the zero lift portion.

5. The mechanically controllable valve drive as recited in claim 1, wherein the turning angle ω of the camshaft in the valve-lift standstill portion is between 70° and 150°.

6. The mechanically controllable valve drive as recited in claim 1, wherein the gas exchange valve comprises at least one hydraulic actuator configured to actuate the gas exchange valve.

7. The mechanically controllable valve drive as recited in claim 1, wherein the gas exchange valve is designed as an outlet valve.

8. The mechanically controllable valve drive as recited in claim 1, wherein the camshaft comprises a second cam configured to provide a second valve lift.

9. An internal combustion engine, the internal combustion engine comprising at least one cylinder comprising at least one inlet valve and at least one outlet valve, wherein the at least one outlet valve is controlled by the mechanically controllable valve drive as recited in claim 1.

10. The internal combustion engine as recited in claim 9, wherein in the internal combustion engine is a diesel engine.

11. The internal combustion engine as recited in claim 9, wherein the at least one gas inlet valve is controlled by a variable valve drive.

* * * * *